US006476569B2

(12) United States Patent
Aoki et al.

(10) Patent No.: US 6,476,569 B2
(45) Date of Patent: Nov. 5, 2002

(54) DEFLECTION APPARATUS, CATHODE RAY TUBE APPARATUS AND BEAM LANDING ADJUSTMENT METHOD

(75) Inventors: Kyousuke Aoki, Fukushima (JP); Teizo Takase, Aichi (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/796,489

(22) Filed: Mar. 2, 2001

(65) Prior Publication Data

US 2002/0047651 A1 Apr. 25, 2002

(30) Foreign Application Priority Data

Mar. 8, 2000 (JP) ..... 2000-063893

(51) Int. Cl.[7] ..... G09G 1/28; H01J 29/70
(52) U.S. Cl. ..... 315/368.11; 313/440
(58) Field of Search ..... 315/364, 365, 315/368.11, 368.25, 368.27, 367.28, 379, 380; 313/380, 409, 413, 415, 421, 440, 441, 442

(56) References Cited

U.S. PATENT DOCUMENTS 5,121,028 A * 6/1992 Milili ..... 313/440
5,489,824 A * 2/1996 Grote et al. ..... 315/371
5,801,496 A * 9/1998 Takita ..... 315/368.11
6,046,713 A * 4/2000 Jamar ..... 345/13
6,218,773 B1 * 4/2001 Misono et al. ..... 313/440
6,225,764 B1 * 5/2001 Shim et al. ..... 315/370

FOREIGN PATENT DOCUMENTS

JP Sho 52-71117 6/1977
JP Hei 05-76018 3/1993

* cited by examiner

*Primary Examiner*—Don Wong
*Assistant Examiner*—Minh D A
(74) *Attorney, Agent, or Firm*—Ronald P. Kananen; Rader, Fishman, & Grauer PLLC

(57) ABSTRACT

A landing correction coil is provided at the rear of a horizontal deflection coil of a deflection yoke or at a position where it is closely coupled with the horizontal deflection coil. The landing correction coil is fixed so as to generate a magnetic field perpendicular to the axis of a CRT.

Moreover, the landing correction coil is connected so that a current flowing in a horizontal deflection coil may flow in the landing correction coil.

Furthermore, the landing correction coil is connected to an adjustment coil for adjusting the current flowing therein.

A varying means is provided in the adjustment coil and the polarity and amplitude of the current flowing in the landing correction coil is adjusted by the varying means. This causes the magnetic field distribution for scanning an electron beam of a CRT to be changed and enables a landing characteristic to be adjusted electrically.

35 Claims, 7 Drawing Sheets

DEFLECTION APPARATUS, CATHODE RAY TUBE APPARATUS AND BEAM LANDING ADJUSTMENT METHOD

BACKGROUND OF THE INVENTION

Field of the Invention

The present invention relates to a deflection apparatus, a cathode ray tube apparatus and a beam landing adjustment method which are applicable to a television receiver or a color monitor device and particularly facilitate an adjustment when installing the deflection apparatus in the cathode ray tube.

DESCRIPTION OF THE RELATIVE ART

In a color television receiver and the like, because a deflection yoke is fitted onto a neck portion of a glass enclosure of the cathode ray tube (hereinafter referred to as CRT) against a funnel portion thereof to be fixed at a predetermined position. Each deflection yoke causes some unevenness in its deflection center if the deflection center of deflection yoke changes, the strike point of an electron beam on a fluorescent screen of a CRT will deviate. Due to the deviation of the strike point, color unevenness will be caused in a picture displayed on a CRT. For this reason, when a color television receiver is manufactured, specifically, the deflection yoke is manually moved for adjustment in the axial direction of the CRT so as to make the color unevenness minimum and then the deflection yoke is fixed on the glass enclosure. Adjusting to make the color unevenness minimum in this manner is termed "Beam Landing Adjustment" or "Landing Adjustment". The deflection yoke is manually moved for adjustment in the axial direction of the neck portion.

With such manual adjustment, it takes much time to fix the deflection yoke in position where unevenness of color disappears, thus, a proposal to correct the deflection center of the deflection yoke electrically is disclosed e.g. in a publication of patent application No. H5-76018.

According to the above publication of patent application No. S52-71117, the following structure is disclosed. A first deflection yoke and a second deflection yoke are provided at a neck portion of a CRT. A sawtooth current synchronized with a horizontal deflection cycle and a vertical deflection cycle is made to flow in each coil of the second deflection yoke. By generating from the second deflection yoke a magnetic field inn the opposite direction to or the same direction as that of a magnetic field generated in the first deflection yoke, a position of the deflection center of the deflection yoke is electrically changed in the axial direction of the neck portion.

According to the above publication of patent application No. H5-76018, the following beam landing correction apparatus is disclosed. A velocity modulation coil is provided at the rear of the deflection yoke fitted onto the neck portion of the CRT. A sawtooth current is made to flow from a sawtooth current generator circuit provided in the receiver into the velocity modulation coil. The beam deflection center position of the deflection yoke is corrected by adjusting the amplitude and polarity of the sawtooth current of the current generator circuit.

According to the above publication of patent application No. S52-71117, it is disclosed that the second deflection yoke is formed by winding a horizontal deflection coil around an annular core to create a parallel magnetic field perpendicular to the axial direction of the neck portion and a horizontal sawtooth current synchronized with a horizontal deflection cycle is made to flow.

It is also disclosed that when the deflection center is to be advanced, the current of such a polarity as creates an opposite magnetic field to the horizontal deflection magnetic field generated by the first deflection yoke is made to flow, and when the deflection center is to be retreated, the current of the same polarity as that of the horizontal deflection magnetic field is made to flow.

However, how to adjust the amplitude and how to switch the polarity of the sawtooth current is not disclosed. Also, in the case of publication of patent application No. H5-76018, the sawtooth current similar to the above must be made to flow in the velocity modulation coil. In order to adjust the sawtooth current the adjustment of polarity and amplitude is required in the sawtooth current generator circuit. In other words, portion and the adjustment is performed, through an amplitude adjusting means and a polarity switching means of the sawtooth current generator circuit provided on the receiver side. Thus, the unevenness of deflection center of deflection yoke cannot be adjusted in a manufacture stage of the deflection yoke. Therefore, the adjustment for eliminating the color unevenness must be performed in a manufacture stage of color television receiver or the like. Thus, it takes much time to adjust, which leads to the increase in costs of manufacturing color television receiver.

OBJECTS AND SUMMARY OF THE INVENTION

The present invention has been made in order to solve the above described problem and is characterized by providing a landing correction coil near the deflection yoke and also providing an adjustment coil for adjusting the amplitude of the sawtooth current in a horizontal deflection cycle, which is made to flow in a landing correction coil. The present invention provides a deflection apparatus, making cathode ray tube apparatus and beam landing adjustment method capable of the beam landing adjustment to be performed more correctly and easily by the above-mentioned feature.

A first deflection apparatus according to the present invention comprises a landing correction coil and an adjustment coil for making a sawtooth current of a horizontal deflection cycle flow in the landing correction coil. This landing correction coil is provided near a horizontal deflection coil of deflection yoke and generated a magnetic field perpendicular to the axial direction of a neck portion of a CRT. The adjustment coil is connected in series with a horizontal deflection coil. The adjustment coil is made to be variable e.g. by a knob and the like. The sawtooth current of a horizontal deflection cycle made flow in the landing correction coil is variable by means of the knob.

A second deflection apparatus according to the present invention is such that, in the first apparatus, the adjustment coil is connected so as to form the bridge circuit, and first and second landing correction coils are connected in series between balance positions of the landing adjustment coil connected to form the bridge circuit.

A third deflection apparatus according to the present invention is such that, in the first apparatus, the landing adjustment coil has a first coil land a second coil connected in parallel with each other, and the landing correction coil is connected in series to either of the first coil and the second coil. The landing correction coil has a first coil and a second coil which are different from those described above and connected in series with each other.

A fourth deflection apparatus according to the present invention is such that, in any of the first to third apparatus, the landing adjustment coils are wound in symmetrical positions on a coil bobbin, and a knob for enabling a magnetic core such as a screw core arranged at the middle of the coil bobbin to move in and out of coils is provided.

A fifth deflection apparatus according to the present invention is such that, in any of the first to fourth apparatus, the landing adjustment coil is comprised of at least two coils and inductances of the at least two coils are differentially changed by moving the magnetic core such as the'screw core.

A sixth deflection apparatus according to the present invention is such that, in any of the first to fifth apparatus, the landing correction coil is arranged in the rear of (toward the neck) the horizontal deflection coil of the deflection yoke, i.e. on the neck side.

A seventh deflection apparatus according to the present invention is such that, in any of the first to fifth apparatus, the landing correction coil is provided within a magnetic field of the horizontal deflection coil of the deflection yoke.

A first cathode ray tube apparatus according to the present invention, comprises a deflection yoke, a landing correction coil and an adjustment coil. The deflection yoke is fitted on the neck portion of a CRT and is installed at a position where the yoke is pressed toward a funnel portion. The landing correction coil is provided at the rear of the horizontal deflection coil of the deflection yoke and generates a magnetic field perpendicular to the axial direction of the neck portion 10; a landing adjustment coil is connected in series with the horizontal deflection coil and used to make the sawtooth current of a horizontal deflection cycle flow in the landing correction coil 6. A varying means such as a knob is provided in the adjustment coil. It is possible to make variable of the sawtooth current of a horizontal deflection cycle flowing in the landing correction coil by means of the varying means.

A second cathode ray tube apparatus according to the present invention comprises a deflection yoke, a landing correction coil and an adjustment coil. The deflection yoke is fitted on the neck portion of the CRT and is installed at a position where the yoke is-pressed toward the funnel portion. A landing. correction coil is provided within a magnetic field of the horizontal deflection coil of the deflection yoke and generates a magnetic field perpendicular to the axial direction of the neck portion 10. The landing adjustment coil 7 is connected in series with the horizontal deflection coil and is used to make the horizontal sawtooth current 11 flow in the landing correction coil. A varying means such as an knob is provided at the adjustment coil. The varying-means can make variable the sawtooth current of the horizontal deflection cycle flowing in the landing correction coil.

A beam landing adjustment method according to the present invention is a method for adjusting electrically a deflection center position of the deflection yoke while fixing the deflection yoke installed in the CRT at a certain point. A landing correction coil is provided within a magnetic field of the horizontal deflection coil or at the rear of the horizontal deflection coil and generates a magnetic field perpendicular to the axial direction of the neck portion of the CRT by providing. The sawtooth current of a horizontal deflection cycle is made to flow in the landing correction coil through the horizontal deflection coil and a the adjustment coil. A varying means for varying the current made to flow in the landing correction coil is provided at the adjustment coil. According the adjustment coil enables the deflection center of the deflection yoke to move electrically in the back and forth direction of the neck portion. Accordingly, the beam landing can be adjusted electrically.

According to the deflection apparatus, the CRT apparatus and the beam landing adjustment method, the adjustment coil and the varying means are capable of adjusting the amplitude of the sawtooth current having the horizontal deflection cycle made to flow in the landing correction coil. This makes it possible to perform the delicate beam landing adjustment more correctly and easily. Therefore, a satisfactory beam landing characteristic can be obtained and a picture with less color unevenness can be displayed. Moreover, in constructing a television receiver, the deflection yoke can be fixed closely to a funnel of a CRT. This enables a deflection sensitivity of the electron beam to be improved and power consumption to be reduced. Furthermore, a long term variation of a mechanical fixed position of the deflection yoke will decrease. Thus, a spacer for fitting the deflection yoke and in turn an adhesive for fixing the deflection yoke spacer will be unnecessary.

DETAILED DESCRIPTION OF A PREFERRED EMBODIMENT

Embodiments of the deflection apparatus, the CRT apparatus and the beam landing adjustment method according to the present invention will be described below with reference to FIG. 1 through FIG. 9.

Figure 1:
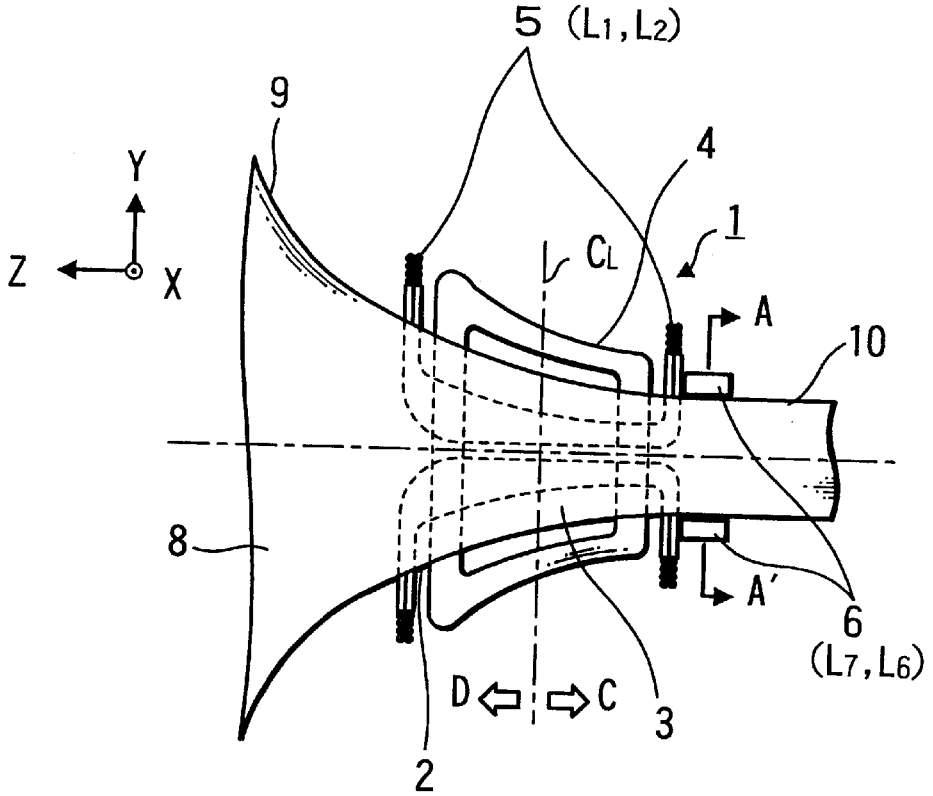
FIG. 1 is partially seen through a side view of the CRT apparatus according to the present invention for describing a layout of a horizontal deflection coil, a vertical deflection coil and a core forming a deflection yoke as well as a layout of a landing correction coil arranged on the neck portion of the horizontal coil.

Referring to FIG. 1, a glass enclosure forming a CRT (CRT) 8 has a funnel portion 9 flaring at a predetermined angle from the neck portion. A panel, not shown, is fitted to an end of the funnel portion 9. A color CRT has, e.g. an aperture grill as color selecting mechanism. The neck portion 10 has an electron gun not shown, in which three color cathodes for displaying R (red), G (green) and B (blue) are arranged e.g. in line. Ahead of the three color cathodes, i.e. in the direction of Z, the electron gun has sequentially a control grid, an acceleration electrode, a convergence and so on. Ahead of the funnel portion, i.e. on the left side of the diagram, the panel not shown is fitted. A fluorescent screen is provided inside the panel. Opposite to the fluorescent screen a color selection mechanism, e.g. an aperture grill not shown.

As shown in FIG. 1, the deflection yoke 2 is fixed on the rear side, i.e. the side of neck portion 10 of a CRT.

Figure 2:
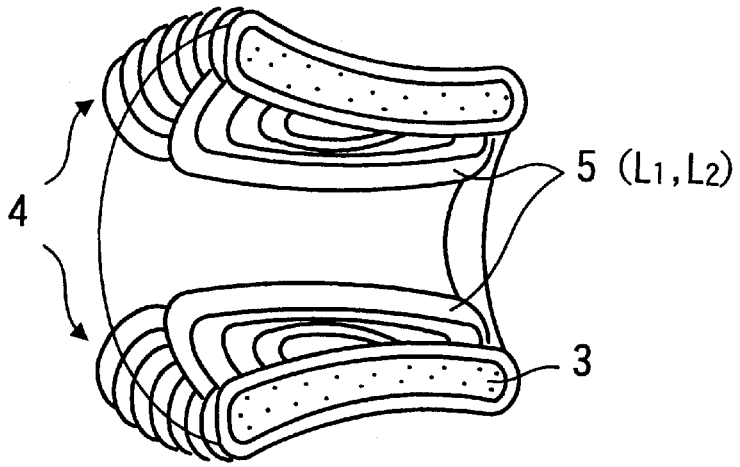
FIG. 2 is an oblique view of a partially cut deflection yoke used in the present invention for showing the relation between a horizontal deflection coil, a vertical deflection coil and a core when they are cut by YZ plane.

As shown in FIG. 2, horizontal deflection coil 5 is wound inside a core 3 such as a ferrite. The core 3 has an opening and flares at a predetermined angle. A vertical deflection coil 4 is wound in the toroidal form covering the core 3. A metal clamp, though not shown, is mounted on the rear side of the deflection yoke 2 shown in FIG. 1, by which clamp the deflection yoke 2 is fixed to the neck portion 10.

A landing correction coil 6 is arranged on the rear side of the deflection yoke 2. Specifically, the landing correction coil 6 is arranged in the rear of the horizontal deflection coil 5, i.e. on the right side of the diagram.

Figure 3B:
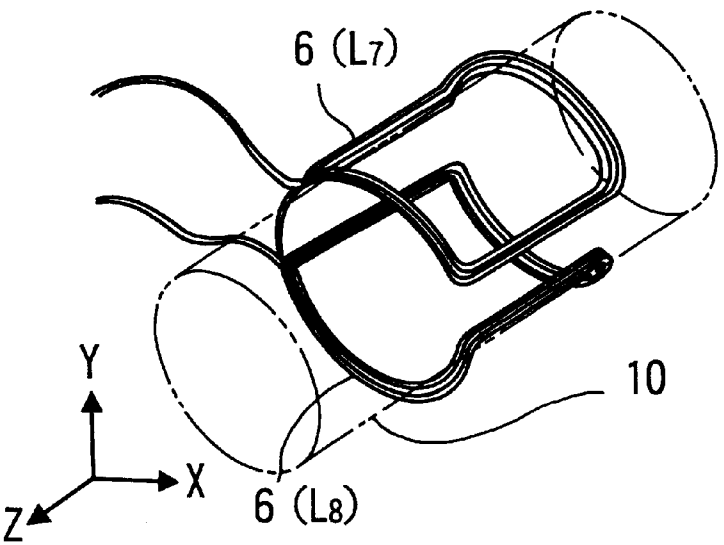
FIG. 3B is a oblique view for showing a layout of a landing correction coil used in the present invention, which shows coils provided on the upper side and the lower side of a neck portion of a CRT.
Figure 3A:
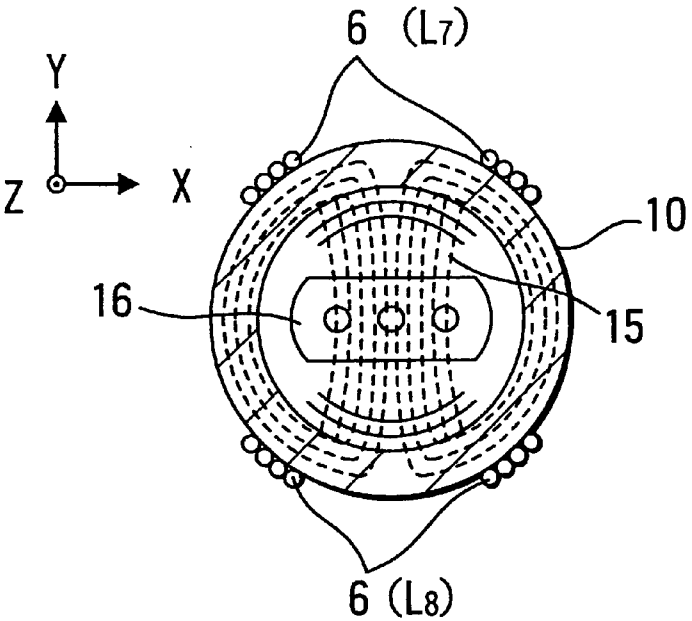
FIG. 3A is a diagram for describing a magnetic field generated by a landing correction coil used in the present invention, which is a diagram when a neck portion 10 in FIG. 1 is cut along a A—A' line and which views the electron gun side. A cathode 16 shows cathodes of the electron gun arranged in line.

This landing correction coil 6 is formed e.g. as shown in FIGS. 3A and 3B. FIG. 3A shows a sectional view of the neck portion 10 looking toward the electron gun taken along a line A—A' in FIG. 1. The landing correction coil 6 is wound so as to generate a parallel magnetic field 15 perpendicular to the axis direction of the neck portion 10, i.e. vertical in FIG. 1. The landing correction coil 6 is fixed to the neck portion 10.

The magnetic field 15 may be a pincushion type magnetic field or a barrel type magnetic field. The landing correction coil 6 is comprised of coils $L_7$ and $L_8$ as shown in FIG. 3B. The coil $L_7$ is mounted on the upper side of the neck portion 10 and both ends of the coil are curved downward along the circumference of the neck portion 10. The coil $L_8$ is fixed on the lower side of the neck portion 10 and both ends of the coil is curved upwards along the circumference of the neck portion 10. The landing correction coil 6 is formed by connecting the coil $L_7$ in series with the coil $L_8$.

The structure of the adjustment coil 7 used in this example will be described with reference to FIG. 4 and FIG. 5.

Figure 4:
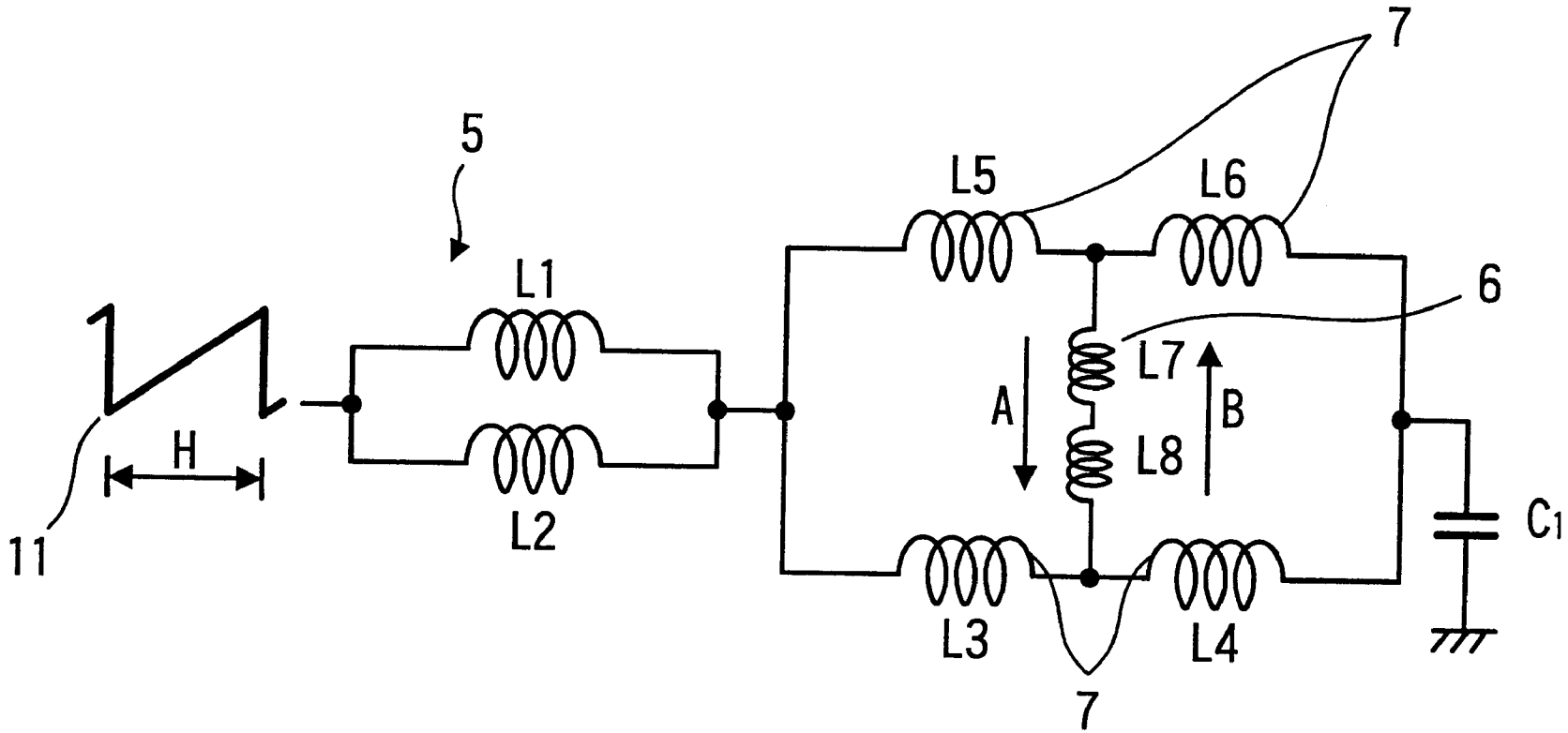
FIG. 4 is a circuit diagram for describing a connection of the deflection apparatus according to the present invention, in which a bridge circuit comprised of a landing correction coil and an adjustment coil is connected in series with a horizontal deflection coil.

A bridge circuit is constructed by four coils $L_3$ to $L_6$ as shown in a circuit diagram of FIG. 4. The coils $L_3$ to $L_6$ form the adjustment coil 7 as shown in FIG. 5. The balance points of the bridge circuit are a connection point of the coils $L_5$ and $L_6$ and another connection point of the coils $L_3$ and $L_4$. The landing correction coil 6 is connected between the balance points of the bridge circuit. The landing correction coil 6 is constructed by directly connecting the coil $L_7$ and the coil $L_8$ with each other. A connection point of the coils $L_4$ and $L_6$ is grounded e.g. through a condensor $C_1$. A connection point of the coils $L_3$ and $L_5$ is connected directly with the horizontal deflection coil 5 which is formed e.g. by connecting coils $L_1$ and $L_2$ in parallel. To the horizontal deflection coil 5 is supplied the sawtooth current 11 for horizontal deflection from a circuit of the receiver (not shown). The sawtooth current 11 is a current having a cycle of the horizontal scanning period H.

Figure 5:
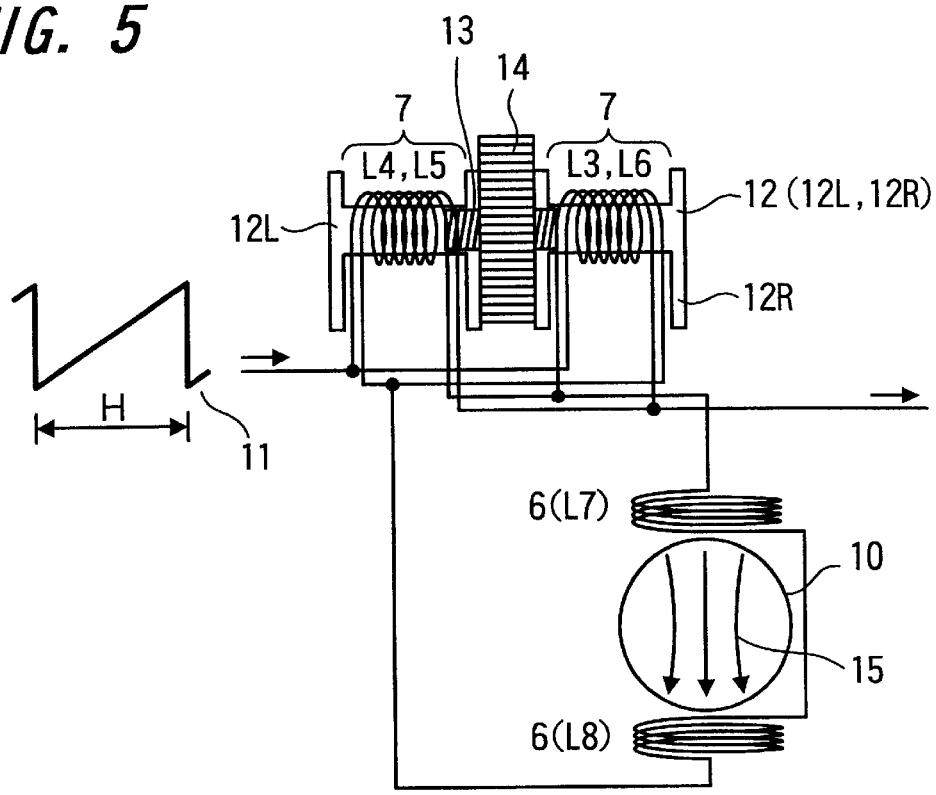
FIG. 5 shows an example of the structure of an adjustment coil according to the present invention and a bridge circuit comprised of a landing correction coil and an adjustment coil.

The landing adjustment coil 7 is constructed by coils $L_3$ to $L_6$ as shown in FIG. 5. A coil bobbin 12 is formed by a coil bobbin 12L on the left side of the diagram and a coil bobbin 12R on the right side of the diagram. The coils $L_3$ to $L_6$ are wound around the left side coil bobbin 12L and the right side coil bobbin 12R, e.g. in the bifilar form. In other words, the coils $L_4$ and $L_5$ may be formed by winding two lines around the coil bobbin 12L simultaneously. Likewise, the coils $L_3$ and $L_6$ may be formed by winding two lines around the coil bobbin 12R simultaneously. The coil bobbins 12L and 12R are arranged to be opposite to each other keeping a predetermined distance. For example, a circuit board not shown is fitted to the deflection yoke 2 and the adjustment coil 7 may be mounted on the board. A screw core 13 is inserted into the inside diameter of the coil bobbin 12. An adjustment knob 14 is provided between the coil bobbin 12L and the coil bobbin 12R. It is arranged that the screw core 13 will move in opposite direction within the inside diameter of the left and right coil bobbins 12L, 12R according to a rotative amount of the knob 14.

As described above, the deflection apparatus 1 of this example comprises the deflection yoke 2, the adjustment coil 7 forming the bridge circuit, and the landing correction coil 6. The adjustment coil 7 forming the bridge circuit is connected directly in series with the horizontal deflection-coil 5. The landing correction coil is connected between the balance points of the bridge circuit. Also, the landing correction coil is arranged near the deflection yoke 2.

An operation of the thus constructed apparatus will be described using FIG. 4 and FIG. 5.

Now, if the knob 14 is turned, then the screw core 13 will move within the inside diameter of the coil bobbin 12. If the core moves to the side of coil bobbin 12L, inductance of the coil $L_4$ and the coil $L_5$ forming the adjustment coil will be greater than inductance of the coil $L_3$ and the coil $L_6$. On the contrary, if the core moves to the side of coil bobbin 12R, inductance of the coils $L_3$ and $L_6$ of the adjustment coil 7 will be greater than inductance of the coils $L_4$ and $L_5$.

The adjustment coil 7 forms the bridge circuit in which the coils $L_4$ and $L_5$ as well as the coils $L_3$ and $L_6$ are arranged diagonally. If the screw core 13 moves, then two inductances of the opposite pairs of the bridge circuit will change simultaneously. Now, it is assumed that the inductances $L_3$ to $L_6$ of the coil are balanced. In this case, the sawtooth current or a horizontal deflection cycle will not flow in the landing correction coil 6 i.e. coils $L_7$ and $L_8$ connected between the balance points of the bridge circuit. However, if the balance is lost, then the sawtooth current of a horizontal deflection cycle will flow in the landing correction coil 6, i.e. coils $L_7$ and $L_8$.

The direction of the current flowing in the landing correction coil 6 changed depending on the balance. In the bridge circuit, when the inductances of coils $L_4$ and $L_5$ are larger than the inductances of other coils $L_3$ and $L_6$, the sawtooth current of a horizontal deflection cycle flows in the direction of an arrow A in FIG. 4. On the contrary, when the inductances of coils $L_3$, $L_6$ are larger than the inductances $L_4$, $L_5$, the sawtooth current of a horizontal deflection cycle flows in the direction of an arrow B in FIG. 4.

Now, consider the case where a current flows in the horizontal deflection coil 5 and the sawtooth current of the horizontal deflection cycle flows in the landing correction coil 6 in the direction of an arrow A in Figure 4. On this occasion, it is assumed that the coils L7,L8 forming the landing correction coil 6 generates a downward magnetic field shown in FIG. 5, i.e. a downward magnetic field 15 in FIG. 3A. Also, it is assumed that the current flowing the horizontal deflection yoke 5 generates a downward horizontal deflection magnetic field in FIG. 1. In this state where the current flows in the A direction of FIG. 4, each of the horizontal deflection coil 5 and the landing correction coil 7 generates a downward magnetic field relative to CRT 8 in FIG. 1. A line CL shown in FIG. 1 represents a central position of the magnetic field distribution of entire deflection apparatus 1. Because the magnetic field generated by the horizontal deflection coil 5 is superposed on the magnetic field of the landing correction coil position of the magnetic field distribution of entire deflection apparatus moves to the side of an arrow C, i.e. the side of neck portion 10.

The moving of the center CL of magnetic field toward the neck portion 10 as shown by the arrow C in FIG. 1 brings the same effect that the whole deflection yoke 2 moves mechanically toward the neck portion 10.

Next, consider the case where the state of the adjustment coil is changed from the above state to make the current flow in the direction of the arrow B in FIG. 4. In this case, the direction of magnetic field due to the horizontally deflection coil 5 does not change. However, the magnetic field due to the landing correction coil 6 is an upward magnetic field. Thus, the magnetic field due to the horizontal deflection coil 5 is canceled by the magnetic field due to the landing correction coil 6. Therefore, the whole magnetic field of deflection apparatus 1 decreases and the center CL of the whole magnetic field moves toward the funnel portion 9 (in the direction of an arrow D in FIG. 1). The moving of the center CL of magnetic field toward the funnel portion 9 as shown by the arrow D in FIG. 1 brings the same effect that the whole deflection yoke 2 moves mechanically toward the funnel portion 9.

As described above, by turning the adjustment knob 14 in FIG. 5 to move the screw core 13, the same operation that the deflection yoke 2 is moved back and forth mechanically can be obtained. Furthermore, because the screw core moves in the opposite directions according to the rotative quantity of the knob 14, it is possible to perform a delicate adjustment. In other words, the adjustment of the deflection center can be facilitated in each deflection yoke. Next, another embodiment according to the present invention will be described.

Figure 6:
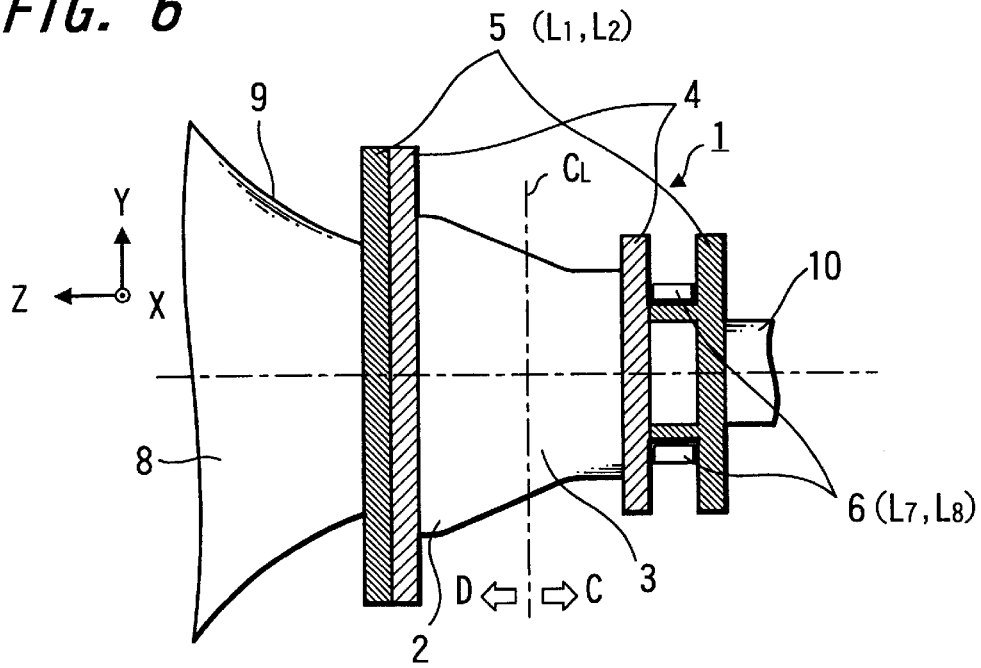
FIG. 6 is side view the CRT apparatus according to the present invention for describing a layout of a horizontal deflection coil, a vertical deflection coil and a core as well as a layout of a landing correction coil fixed within a magnetic field generated by a horizontal coil.

FIG. 6 shows a side view of the cathode ray tube apparatus in which according to the present invention is used. FIG. 6 is a diagram for describing the layout of the horizontal deflection coil, the vertical deflection coil and the core which form the deflection yoke as well as the layout of the landing correction coil installed in a magnetic field generated by the horizontal coil.

In this embodiment, the landing correction coil 6 is rearranged a current may be induced 2 so that by electromagnetic induction due to the horizontal deflection magnetic field. Specifically, in FIG. 6, the coils $L_7$ and $L_8$ of the landing correction coil 6 such as described with FIG. 3B are arranged on the upside of the horizontal deflection coil 5 of the deflection yoke 2 so as to magnetically couple closely with the horizontal deflection coil 5.

Figure 7:
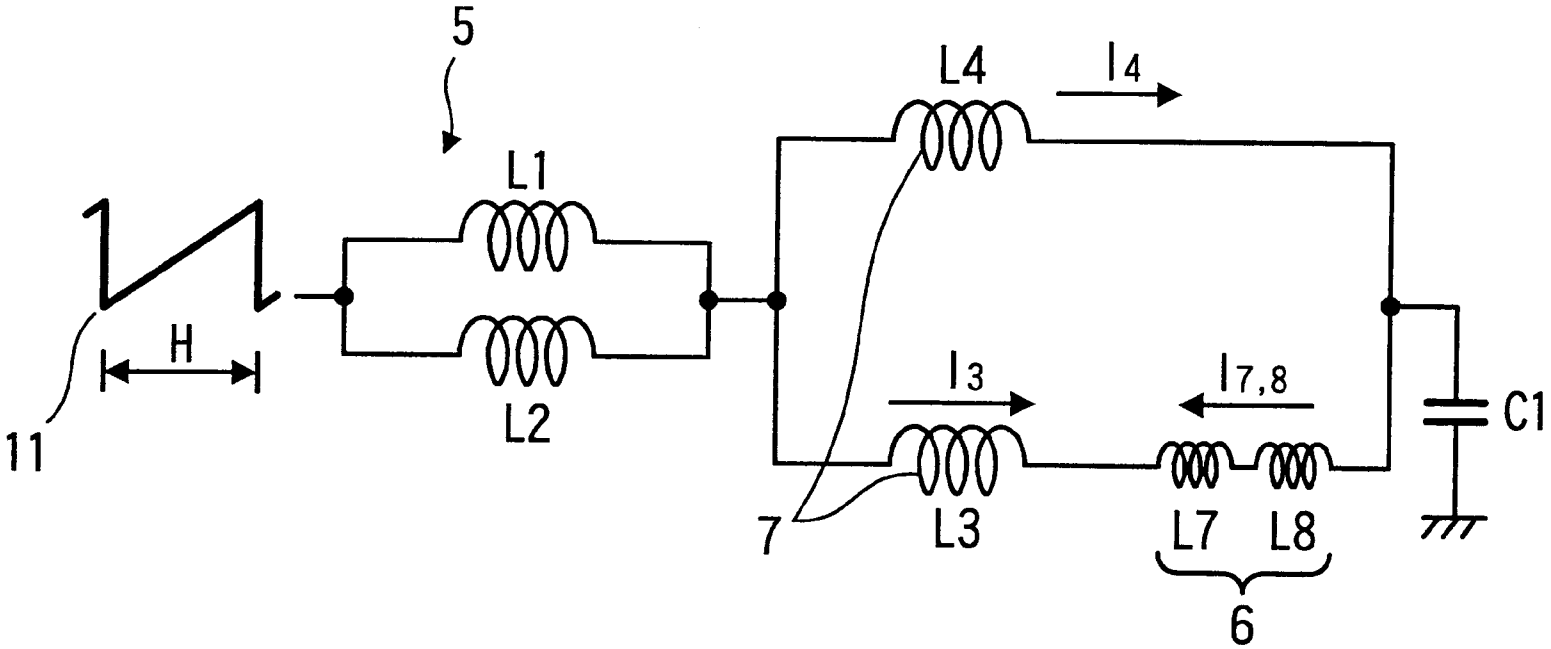
FIG. 7 is a circuit diagram for describing another connection of the deflection apparatus according to the present invention, which shows an adjustment coil connected in parallel and a landing correction coil connected in series with one end of the adjustment coil.
Figure 8:
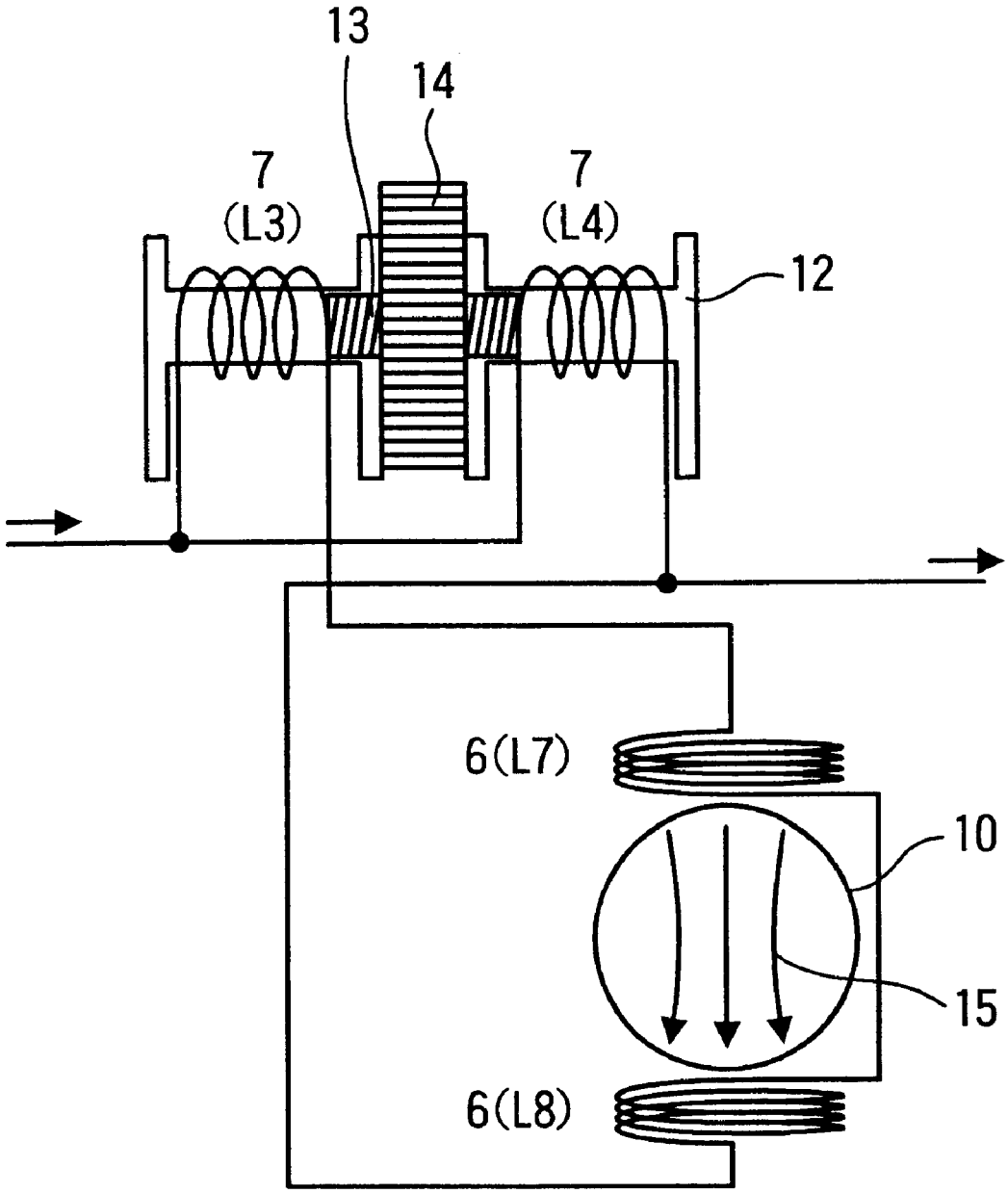
FIG. 8 shows another example of the structure of an adjustment coil according to the present invention and a bridge circuit comprised of a landing correction coil and an adjustment coil.

FIG. 7 shows an overall circuit diagram of the deflection apparatus having the above described structure. FIG. 8 shows the structure of the adjustment coil 7. Like parts in FIGS. 6 to 8 corresponding to those in FIGS. 1 to 5 are denoted by like reference numerals to omit repeated descriptions.

The adjustment coil 7 in this example is comprised of coils $L_3$ and $L_4$ connected in parallel to each other as shown in FIG. 7. The horizontal deflection coil 5 has coils $L_1$ and $L_2$ connected in parallel. The landing correction coil 6 has coils $L_7$ and $L_8$ connected in series with each other. Thus, an induced current $I_{7.8}$ will flow in the landing correction coil 6. The adjustment coil 7 is connected in series with the horizontal deflection coil 5.

One end of the coil $L_7$ of the landing correction coil 6 is connected in series with the coil $L_3$. The coil $L_4$ and the coil $L_8$ is connected to each other and further connected to one end of a condenser C, other end of which is grounded. The landing correction coil 6 is connected in parallel to the coil $L_4$ of the adjustment coil 7.

The coils $L_3$ and $L_4$ of the adjustment coil 7 are wound around the coil bobbin 12 as shown in FIG. 8. A screw core 13 will move in the opposite directions by turning a knob 14.

The above described operation shown in FIG. 6 to FIG. 8 will be described below with reference to wave forms of the current shown in FIGS. 9A to 9E.

When the adjustment knob 14 shown in FIG. 8 is turned, the screw core 13 moves within the inside diameter of the coil bobbin 12 in the left and right directions of the diagram. This makes values of the coils $L_3$ and $L_4$ in a manner that if one of them increases, the other decreases. In other words the above two inductances will change differentially and its balance will vary. Because the coils $L_3$ and $L_4$ of the landing adjustment coil 7 are connected in parallel to each other, the sawtooth current 11 for horizontal deflection is divided to flow in the respective coils. Thus, a current $I_3$ flows ion the coil $L_3$ and a current $I_4$ flows in the coil $I_4$ as shown in FIG. 7. The quantities of the above currents change depending on the balance of inductances of the coil $L_3$ and the coil $L_4$.

On the other hand, current $I_{7.8}$ is induced in the landing correction coil 6.

Therefore, the current flowing in the landing correction coil 6 is a resultant current of the induced current $I_{7.8}$ and the branch current $I_3$ of the sawtooth current 11 for horizontal deflection.

Figure 9A:
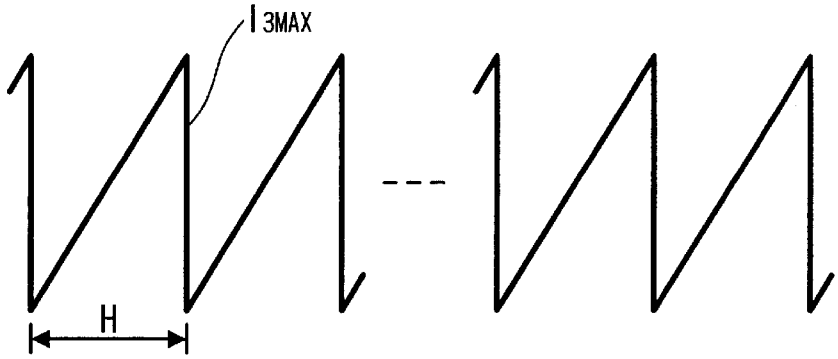
FIG. 9A shows a wave form of the current $I_3$ in a state where the current $I_3$ flowing in the coil $L_3$ is made to be maximum by changing the balance of the adjustment coil 7, when a horizontal deflection current 11 is divided into branch currents $I_3$ and $I_4$ in FIG. 7.
Figure 9B:
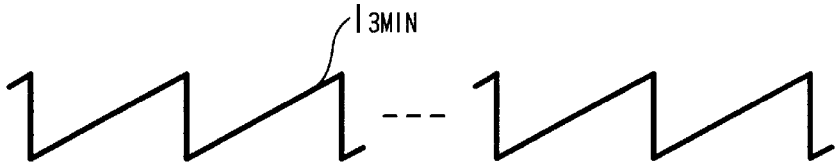
FIG. 9B shows a wave form of the current $I_3$ in a state where the current $I_3$ flowing in the coil $L_3$ is made to be minimum by changing the balance of the adjustment coil 7, when a horizontal deflection current 11 is divided into branch currents $I_3$ and $I_4$ in FIG. 7.
Figure 9C:
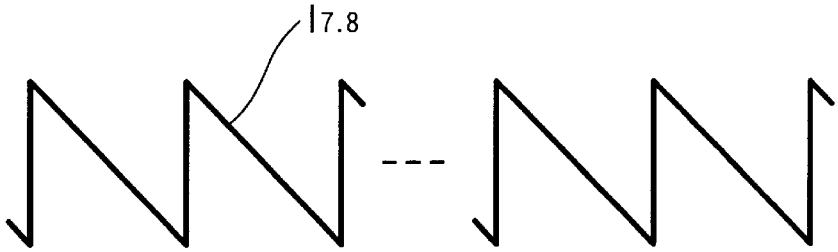
FIG. 9C shows a wave form of a current induced in the landing correction coil 6 and particularly shows the current $I_{7,8}$ induced in the landing correction coil 6 by a change in magnetic field due to the horizontal deflection coil 5.
Figure 9D:
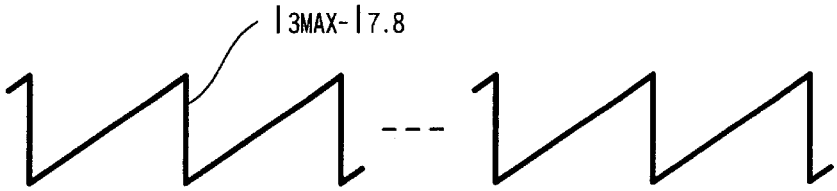
FIG. 9D shows a wave form of a current flowing in the landing correction coil 6 and shows the case where the wave form of FIG. 9A and the wave form FIG. 9C are synthesized.

The balance of inductances of the coils $L_3$ nd $L_4$ will change by moving the knob 14 in FIG. 8. Thus, it is possible to change the current $I_3$ from the maximum amplitude $I_{3MAX}$ to the minimum amplitude $I_{3MIN}$ as shown in FIG. 9A and FIG. 9B. The induced current $I_{7,8}$ in the landing correction coil 6 depended on the coupling strength between the horizontal deflection coil 5 and the landing correction coil 6, i.e. an electromagnetic induction coefficient. The FIG. 9C shows the induced current $I_{7,8}$. As described above, the current flowing in the landing correction coil 6 is the resultant current of the current $I_3$ and the induced current $I_{7,8}$. Specifically, in the state that the current $I_3$ is maximum, wave forms of FIG. 9A and FIG. 9C are synthesized. Therefore, the current flowing in the landing correction coil 6 has a wave form as shown in FIG. 9A and FIG. 9C are synthesize . Therefore, the current flowing in the landing correction coil 6 has a wave form as shown in FIG. 9D. On the other hand, in the state that the current I3 is minimum, wave forms of FIG. 9B and FIG. 9C are synthesized. Therefore, the current flowing in the landing correction coil 6 has a waveform as shown in FIG. 9E.

Now, it is assumed that the direction of magnetic field generated by the landing correction coil 6 is, when a current of the polarity shown in FIG. 9D flows, the same direction as that of magnetic field generated by the horizontal deflection coil 5.

In this case, in addition to the magnetic field generated by the horizontal deflection coil 5, the magnetic field generated by the landing correction coil 6 fitted on the neck portion affect the CRT in FIG. 6. Because the magnetic field generated by the landing correction coil 6 fitted on the neck portion affects the CRT in FIG. 6. Because the magnetic field generated by the horizontal deflection coil 6 is added to the magnetic field generated by the horizontal deflection coil 5, having the same direction as that of the former magnetic field, the central position of whole magnetic field distribution of the deflection apparatus 1 will move toward the neck portion 10 as shown by an arrow C in FIG. 6. The moving of the center CL of magnetic field toward the neck portion 10 as shown by an arrow C in FIG. 6 brings the same effect that the whole deflection yoke 2 moves mechanically toward the neck portion 10.

Figure 9E:
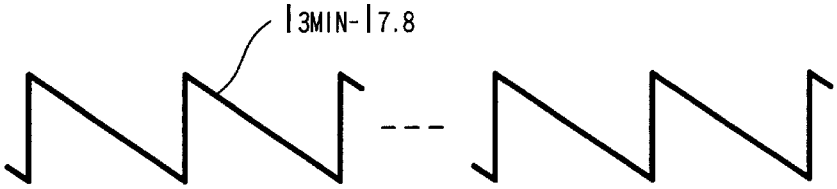
FIG. 9E shows a wave form of a current flowing in the landing correction coil 6 and shows the case where the wave form of FIG. 9B and the wave form of FIG. 9C are synthesized.

When the balance of the adjustment coil 7 is changed and the current of the polarity shown in FIG. 9E flow the direction of magnetic field generated by the landing correction coil 6 will be opposite to that of the magnetic field generated by the horizontal deflection coil 5. Therefore, the magnetic field due to the horizontal deflection coil 5 is canceled by the magnetic field due to the landing correction coil 6 in the neck portion of CRT. Thus, the magnetic field of entire deflection apparatus 1 shown in FIG. 1 decreases and the center CL of whole magnetic field will move toward the funnel portion 9 as shown by an arrow D in FIG. 6. The moving of the center CL of the magnetic field toward the funnel portion 9 as shown by the arrow D in FIG. 6 brings the same effect that the whole deflection yoke 2 mechanically move toward the funnel portion 9.

In this embodiment, by utilizing the induced current of the landing correction coil, it is possible to obtain the same effect that the deflection yoke is mechanically retreated by moving the screw core using the knob provided in the adjustment coil.

Moreover, because the screw core moves in the opposite directions according to a rotative quantity of the knob 14, a delicate adjustment is enabled. In other words, the adjustment of the deflection center can be facilitated in each deflection yoke.

According to the deflection apparatus, the CRT apparatus and the beam landing adjustment method of the present invention, the amplitude of the sawtooth current of the horizontal deflection cycle made to flow in the landing correction coil can be adjusted by the adjustment coil and the varying means.

This makes it possible to perform a delicate beam landing adjustment correctly and easily.

Therefore, it is possible to obtain a satisfactory beam landing characteristic and display a picture with a few color unevenness.

Moreover, in constructing the receiver, it is possible to fix the deflection yoke in a state that it is stuck to the funnel of a CRT.

This makes the deflection sensibility of electron beam to be improved and causes the power consumption to be reduced.

Furthermore, a long term variation of a position mechanically fixing the deflection yoke will be lessened.

In addition, a space for fixing the deflection yoke and an adhesive, etc. for fixing the deflection yoke spacer will be unnecessary.

Having described preferred embodiments of the present invention with references to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A deflection apparatus characterized by comprising:

a landing correction coil provided within a magnetic field of a horizontal deflection coil of a deflection yoke or at the rear of the horizontal deflection coil to generate a magnetic field perpendicular to the axial direction of a nexk portion of a cathode ray tube;

an adjustment coil connected in series with the horizontal deflection coil to make a sawtooth current synchronized with a horizontal deflection cycle flow in the landing correction coil; and a varying means for varying the horizontal sawtooth current made to flow in the landing correction coil, wherein said deflection yoke is electrically movable along at least one of said funnel portion and said neck portion as a result of said sawtooth current flowing in the landing correction coil.

2. The deflection apparatus according to claim 1, characterized in that the adjustment coil is connected so as to form a bridge circuit; and the landing correction coil comprised of first and second coils is connected between balance positions of the adjustment coil forming the bridge circuit.

3. The deflection apparatus according to claim 1,characterized in that the adjustment coil has first and second coils connected in parallel with each other, and to either of the first and second coils there is connected the first and second coils of the landing correction coil.

4. The deflection apparatus according to any one of claims 1 to 3, characterized in that the landing adjustment coil is wound in symmetrical positions on a coil bobbin and has an adjustment knob for enabling a magnetic core arranged at the middle of the coil bobbin to be moved in and out of the symmetrically wound landing adjustment coil.

5. The deflection apparatus according to claim 4, characterized in that the adjustment coil is comprised of at least two coils are differentially changed by moving the magnetic core.

6. The deflection apparatus according to claim 4, characterized in that the landing correction coil is arranged in the rear of the horizontal deflection coil of the deflection yoke.

7. The deflection apparatus according to claim 4, characterized in that the landing correction coil is provided within a magnetic field of the horizontal deflection coil of the deflection yoke.

8. The deflection apparatus according to any one of claims 1 to 3, characterized in that the adjustment coil is comprised of at least two coils are differentially changed by moving the magnetic core.

9. The deflection apparatus according to claim 8, characterized in that the landing correction coil is arranged in the rear of the horizontal deflection coil of the deflection yoke.

10. The deflection apparatus according to claim 8, characterized in that the landing correction coil is provided within a magnetic field of the horizontal-deflection coil of the deflection yoke.

11. The deflection apparatus according to any one of claims 1 to 3, characterized in that the landing correction coil is arranged in the rear of the horizontal deflection coil of the deflection yoke.

12. The deflection apparatus according to claim 11, characterized in that the landing correction coil is provided within a magnetic field of the horizontal deflection coil of the deflection yoke.

13. A deflection apparatus according to any one of claims 1 to 3, characterized in that the landing correction coil is provided within a magnetic field of the horizontal deflection coil of the deflection yoke.

14. The deflection apparatus according to claim 1, characterized in that a deflection yoke is mountable on said cathode ray tube, said cathode ray tube having a funnel portion connected to said neck portion, said deflection yoke including said horizontal deflection coil, said landing correction coil, and said adjustment coil, said landing correction coil generating a landing correction coil magnetic field, said deflection yoke being electrically movable along at least one of said funnel portion and said neck portion as a result of said landing correction coil magnetic field.

15. The deflection apparatus according to claim 14, characterized in that said deflection yoke is electrically movable along at least one of said funnel portion and said neck portion as a result of said landing correction coil magnetic field.

16. A CRT apparatus having a deflection yoke that is fitted onto a neck portion of a CRT and installed at a position where the yoke is pressed toward a funnel portion, characterized by comprising:

a landing correction coil provided at the rear of a horizontal deflection coil of the deflection yoke to generate a magnetic field perpendicular to the axial direction of the neck portion;

an adjustment coil connected in series with the horizontal deflection coil to make a sawtooth current of a horizontal deflection cycle flow in the landing correction coil; and a varying in means for varying the sawtooth current of the horizontal deflection cycle made to flow in the landing correction coil.

17. A CRT apparatus having a deflection yoke that is fitted onto a neck portion of a CRT and installed at a position where the yoke is pressed toward a funnel portion, characterized by comprising:

a landing correction coil provided within a magnetic field of a horizontal deflection coil of the deflection yoke to generate a magnetic field perpendicular to the axial direction of the neck portion;

an adjustment coil connected in series with the horizontal deflection coil to make a sawtooth current of a horizontal deflection cycle in the landing correction coil; and a varying means for varying the sawtooth current of the horizontal deflection cycle flow made to flow in the landing correction coil, wherein said deflection yoke is electrically movable along at least one of said funnel portion and said neck portion as a result of said sawtooth current flowing in the landing correction coil.

18. A beam landing adjustment method for adjusting electrically a deflection center position of a deflection yoke that is installed in a CRT and fixed at a certain point, characterized by comprising the steps of:

generating a magnetic field perpendicular to the axial direction of a neck portion of the CRT by providing a landing correction coil within a magnetic field of a horizontal deflection coil of the deflection yoke or at the rear of the horizontal deflection coil;

making a sawtooth current of a horizontal deflection cycle flow in the landing correction coil through the horizontal deflection coil and an adjustment; and adjusting the beam landing by varying the sawtooth current of the horizontal deflection cycle made to flow in the landing correction coil using the adjustment coil to move electrically the deflection center of the deflection yoke in the back and forth direction of the neck portion.

19. A deflection apparatus characterized by comprising:

a deflection yoke mountable on a cathode ray tube, said cathode ray tube having a funnel portion connected to a neck portion, said deflection yoke including a horizontal deflection coil, a landing correction coil, and an adjustment coil, said landing correction coil generating a landing correction coil magnetic field, said deflection yoke being electrically movable along at least one of said funnel portion and said neck portion as a result of said landing correction coil magnetic field.

20. The deflection apparatus according to claim 19, wherein adjustment of said landing correction coil electrically moves said magnetic field said deflection yoke along said at least one of said funnel portion and said neck portion.

21. The deflection apparatus according to claim 19, wherein said landing correction coil generates a magnetic field that is perpendicular to the axis direction of said neck portion.

22. The deflection apparatus according to claim 19, wherein said horizontal deflection coil is in series with said adjustment coil.

23. The deflection apparatus according to claim 19, wherein a sawtooth current is applied to said horizontal deflection coil, said landing correction coil magnetic field being generated when said sawtooth current flows within said landing correction coil.

24. The deflection apparatus according to claim 19, wherein said landing correction coil includes a plurality of landing correction coils, a first landing correction coil of said plurality of landing correction coils being in series with a second landing correction coil of said plurality of landing correction coils.

25. The deflection apparatus according to claim 19, wherein said adjustment coil includes a plurality of adjustment coils, a first adjustment coil of said plurality of adjustment coils being in series with a second adjustment coil of said plurality of adjustment coils, a first connection point electrically connecting said first adjustment coil to said second adjustment coil, a third adjustment coil of said plurality of adjustment coils being in series with a fourth adjustment coil of said plurality of adjustment coils, a second connection point electrically connecting said third adjustment coil to said fourth adjustment coil, said landing correction coil being electrically connected to said first connection point and said second connection point.

26. The deflection apparatus according to claim 25, wherein said landing correction coil includes a plurality of landing correction coils, a first landing correction coil of said plurality of landing correction coils being in series with a second landing correction coil of said plurality of landing correction coils, said first landing correction coil being electrically connected to said first connection point, and said second landing correction coil being electrically connected to said second connection point.

27. The deflection apparatus according to claim 26, wherein said first landing correction coil is disposed on the upper side of said neck portion and said second landing correction coil is disposed on the lower side of said neck portion.

28. The deflection apparatus according to claim 25, wherein a third connection point electrically connects said second adjustment coil to said fourth adjustment coil, a capacitor being electrically connected to said third connection point.

29. The deflection apparatus according to claim 28, wherein said capacitor is connected to ground.

30. The deflection apparatus according to claim 25, wherein a fourth connection point electrically connects said first adjustment coil to said third adjustment coil, said horizontal deflection coil being electrically connected to said fourth connection point.

31. The deflection apparatus according to claim 19, wherein said adjustment coil includes a plurality of adjustment coils, a first adjustment coil of said plurality of adjustment coils is in parallel with a second adjustment coil of said plurality of adjustment coils and said landing correction coil, said landing correction coil being electrically connected to said first adjustment and said second adjustment coil.

32. The deflection apparatus according to claim 31, wherein said landing correction coil includes a plurality of landing correction coils, a first landing correction coil of said plurality of landing correction coils being in series with a second landing correction coil of said plurality of landing correction coils.

33. The deflection apparatus according to claim 32, wherein said first landing correction coil is disposed on the upper side of said neck portion and said second landing correction coil is disposed on the lower side of said neck portion.

34. The deflection apparatus according to claim 32, wherein a capacitor is electrically connected to said landing correction coil and said first adjustment coil.

35. The deflection apparatus according to claim 34, wherein said capacitor is connected to ground.

* * * * *